United States Patent [19]

Baker

[11] Patent Number: 4,515,238

[45] Date of Patent: May 7, 1985

[54] PORTABLE ACOUSTICAL SHIELD AND SOUND ENHANCING CLOSURE

[76] Inventor: Warren N. Baker, 3763 Lanier Dr., Baton Rouge, La. 70814

[21] Appl. No.: 543,773

[22] Filed: Oct. 20, 1983

[51] Int. Cl.[3] ..... F04B 1/99

[52] U.S. Cl. ..... 181/30; 181/287

[58] Field of Search ..... 181/30, 284, 287; 160/135, 229 R, 351; 16/243, 248, 382, DIG. 13

[56] References Cited

U.S. PATENT DOCUMENTS

| | | | |
|---|---|---|---|
| 1,282,685 | 10/1918 | Goldhahn | 160/135 X |
| 1,896,844 | 2/1933 | Hanson | 181/30 |
| 2,587,698 | 3/1952 | Corn, Jr. et al. | 160/135 |
| 3,232,370 | 2/1966 | Jaffe | 181/30 |
| 3,435,909 | 4/1969 | Wenger et al. | 181/30 |
| 3,908,787 | 9/1975 | Wenger et al. | 181/30 |
| 3,975,850 | 8/1976 | Giaume | 40/125 H |
| 4,163,303 | 8/1979 | Hanna | 16/DIG. 13 X |
| 4,278,145 | 7/1981 | Eude et al. | 181/30 |
| 4,290,332 | 9/1981 | Schoeffling, Jr. | 84/1.14 |

*Primary Examiner*—Benjamin R. Fuller

*Attorney, Agent, or Firm*—Karen M. Gerken; Martin P. Hoffman; Mitchell B. Wasson

[57] ABSTRACT

A portable acoustical shield and sound enhancing enclosure including vertical lower panel sections connected to each other by removable Velcro ® hinges to form a shield or enclosure of a desired configuration. Upper panel sections are secured to the lower panel sections at any desired angle by removable padded clamps. The acoustical shield and sound enhancing enclosure is located between a musician and his audience for reducing the stage front volume of instruments and for maximizing sound separation and clarity.

9 Claims, 5 Drawing Figures

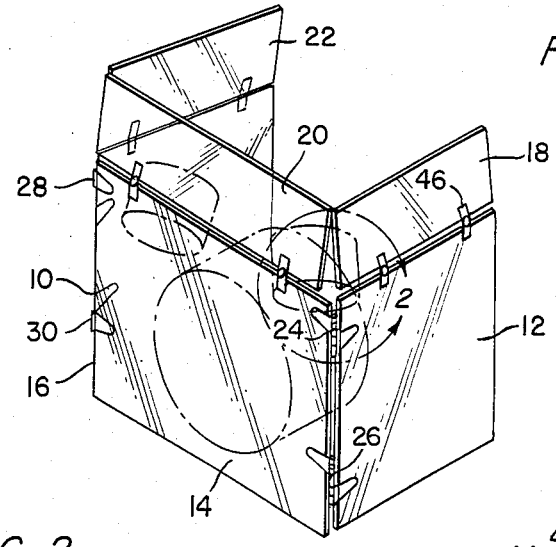
FIG. 1.
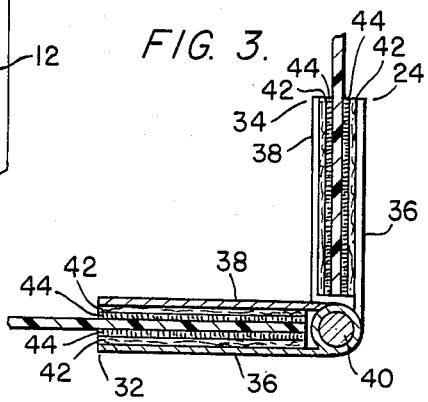
FIG. 3.
FIG. 2.
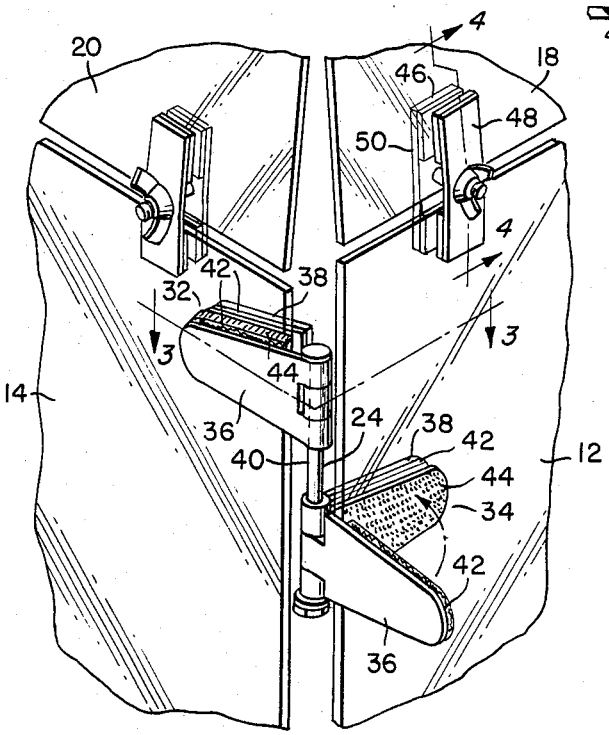
FIG. 4.
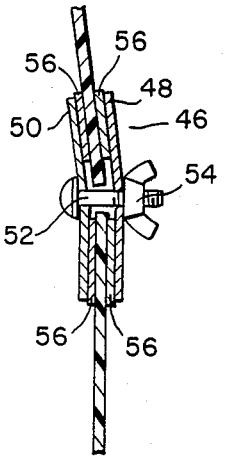
FIG. 5.
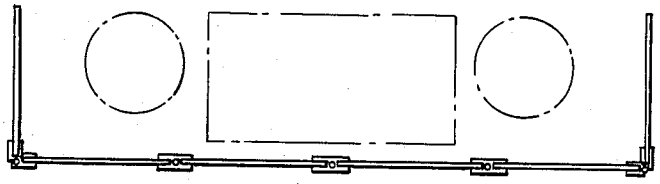

PORTABLE ACOUSTICAL SHIELD AND SOUND ENHANCING CLOSURE

BACKGROUND OF THE INVENTION

The instant invention relates to a portable acoustical shield and sound enhancing enclosure that is defined by cooperating transparent plastic panels interconnected by unique padded clamps. In a live performance, particularly in smaller buildings where minimum volume is critical, it is desirable to reduce the amount of sound directed toward the audience from the source. Reflecting the sound back to the source allows for sound absorption and superior definition of sound through the central public address system. It is further desirable, in the performing arts, to improve the clarity of sound by preventing interference attributable to the pick up of a musician's sound by a fellow musician's microphone.

A portable structure for separating a particular musician from other musicians to prevent interference among sounds is disclosed in U.S. Pat. No. 4,290,332 to Schoeffling, Jr., which describes an upper and lower sandwich of plastic sheets held in place by a frame and hinge assembly.

Various other portable acoustical structures are directed to reflecting sound. U.S. Pat. No. 4,278,145 to Eade et al. discloses a concert shell comprising curvilinear panels mounted in frames wherein the upper panels are cantilevered in relation to the lower panels. Similar devices are shown in U.S. Pat. No. 3,908,787 to Wenger et al. and 3,232,370 to Jaffe.

None of the prior art devices serves to both reflect and separate sound while requiring few parts and being simple to assemble, to dismantle and to transport.

It is an object of this invention to provide an acoustical shield between a musician and his audience for reducing the stage volume of an instrument so that the sound may be controlled more accurately by microphone.

It is an additional object of this invention to provide an acoustical shield for reflecting sound back to the sound source for absorption.

It is a further object of this invention to provide an acoustical shield for reflecting sound back to the sound source for superior definition of sound through the central public address system.

Another object of this invention is to provide a sound enhancing enclosure for improving the clarity of sound by eliminating the interference of sound from one instrument in the microphone of another instrument.

Another object of this invention is to provide a sound enhancing enclosure for maximizing the separation of sound among various instruments.

A further object of this invention is to provide an acoustical shield and sound enhancing enclosure that is easily assembled and disassembled.

It is also an object of this invention to provide an acoustical shield and sound enhancing enclosure that is lightweight and is easily packaged and transported.

Another object of this invention is to provide an acoustical shield and sound enhancing enclosure that is visually unobstructive.

Another object of this invention is to provide an acoustical shield and sound enhancing enclosure that does not require a panel supporting frame.

SUMMARY OF THE INVENTION

The foregoing objects and other features of the invention are attained by a portable acoustical shield and sound enhancing enclosure made up of a plurality of upper and lower panel sections. The lower panel sections are transparent standing panels to which are connected upper panel sections of a similar material and not greater in width than the lower panel sections. The lower panel sections are connected to each other by removable Velcro® hinges such that the connected lower panel sections are disposed in an angular or straight line vertical standing relationship upon the floor in front of a musician.

Each upper panel section is vertically disposed above a lower panel section at any desired angle. The upper panel sections are connected to their respective lower panel sections by removable padded clamps and wing nuts.

The completed arrangement, comprising any number of connected upper and lower panel sections disposed at any desired angle, defines a shield or enclosure of a particular configuration between the musician and his audience.

The panels may be of any desired material that is transparent, lightweight and durable, such as "styrene" plastic. The completed arrangement may be easily dismantled by removing the padded clamps and the hinges. The panels and hardware may then be packed and transported.

BRIEF DESCRIPTION OF THE DRAWINGS

The preferred embodiments of the invention are described below with reference to the following drawings:

FIG. 1 is a left front view as viewed from the audience facing a musician;

FIG. 2 is an enlarged perspective view of the encircled portion of the embodiment of FIG. 1, showing the removable hinge and padded clamp assemblies;

FIG. 3 is a cross-sectional view of a hinge taken along line 3—3 of FIG. 2;

FIG. 4 is a cross-sectional view of a padded clamp taken along line 4—4 of FIG. 2; and FIG. 5 is a view of a first alternative embodiment of the instant invention.

DETAILED DESCRIPTION OF THE PREFERRED EMBODIMENTS

Referring to the drawings, FIG. 1 shows an acoustical shield and sound enhancing enclosure, indicated generally at 10, constructed in accordance with the principles of this invention. The enclosure 10 consists of a plurality of lower panel sections 12,14 and 16 to which are connected, respectively, a like plurality of upper panel sections 18,20 and 22. Both the upper and lower panel sections are preferably similarly constructed of a transparent, durable and lightweight plastic, such as "styrene."

The lower panel sections are of a square, rectangular or other configuration permitting a plurality of connected panels to be arranged in a vertical standing relationship on the floor in front of a musician as shown in FIG. 1. Lower panel sections 12 and 14 are connected to each other by removable Velcro® hinges 24 and 26 located near the top and bottom side edges of the panels. Removable Velcro® hinges 28 and 30 similarly connect lower panel sections 14 and 16.

Since the removable Velcro® hinges are identical, each will be described with reference to hinge 24 as best depicted in FIGS. 2 and 3. Hinge 24 is a double hinge having two flat tapered hinge bodies, indicated generally at 32 and 34, each formed of two cooperating halves 36 and 38 rotatably mounted in a conventional hinge relationship on a bolt 40 headed at each end.

The interior surfaces of each of halves 36 and 38 are provided with a layer of Velcro® or other hook and loop material 42. The cooperating halves may be locked together by means of the Velcro® surfaces when the acoustical shield and sound enhancing enclosure is unassembled and the hinges are not in use. When it is desired to utilize the hinges for connecting the lower panel sections, the hinge body is opened by separating the cooperating halves to break the Velcro® seal.

Each hinge body 32 and 34 is rotatable about the axis of bolt 40 so that they may be disposed relative to each other to achieve the desired angular relationship for the connected lower panel sections.

Each hinge body accepts a different lower panel section. As can be seen in FIG. 2, hinge body 32 of hinge 24 accepts lower panel section 14 while hinge body 34 of hinge 24 accepts lower panel section 12. In order to attach the hinge bodies to the appropriate lower panel sections, the front and rear surfaces of the lower panel sections are provided with Velcro® or other hook and loop material strips 44 located so as to communicate with the Velcro® layers 42 on the interior surfaces of the corresponding halves of the appropriate hinge body.

When it is desired to assemble the lower panel sections, a lower panel section with the appropriately located Velcro® strips is inserted between the separated halves of the corresponding hinge body. The hinge body is locked into place on the panel by closing the cooperating halves of the hinge body to establish communication between the Velcro® layers on the interior surfaces of the cooperating halves and the Velcro® strips on the front and rear surfaces of the lower section panel. Similarly, the remaining hinge body comprising the hinge is connected with the lower section panel that has Velcro® strips located to communicate with the Velcro® layers on the cooperating halves of the hinge body. As illustrated in FIG. 1, a hinge arrangement as thus described is found near both the top and bottom side edges of adjacent panel sections.

Each lower panel section has connected thereto an upper panel section no greater in width than the lower panel section to which it is attached. The upper panel sections may extend above the lower panel sections at any desired angle, preferably 30° from the vertical.

Each upper panel section 18,20 and 22 is secured to its respective lower panel section 12,14 and 16 by at least two padded clamp assemblies located at each side of the panel section. The padded clamp assemblies are identical and will be described with reference to padded clamp assembly 46 as best depicted in FIGS. 2 and 4.

Padded clamp assembly 46 includes two identical rigid bodies 48 and 50 having a bolt 52 headed at one end extending through the central portion of both bodies. Bolt 52 is threaded at its opposite end for accepting wing nut 54. The interior surface of each body 48 and 50 above and below the bolt is provided with a square of padding material 56, such as soft rubber. That portion of the bodies 48 and 50 disposed above the bolt and wing nut is angled, for example 30° from vertical, to achieve the desired angular relationship between the upper and lower panel sections.

FIG. 5 illustrates an alternative embodiment of the invention wherein a series of panels is disposed in a straight line configuration to form a larger acoustic shield and enclosure. In this embodiment, only the last two lower panels on each end of the structure are disposed at an angle.

While the invention has been described with respect to particular embodiments thereof, it is not confined to the details set forth and includes variations and modifications that may be made without departing from the spirit and scope of the invention. Consequently, the appended claims should be liberally construed commensurate with the scope of the invention and should not be limited to their literal terms.

What is claimed is:

1. An acoustical shield and sound enhancing enclosure comprising a plurality of lower panel sections adapted to be arranged vertically at a desired angle to each other, said lower panel sections being provided on their front and rear surfaces with a plurality of strips of hook and loop material, each of said lower panel sections being connected to the next adjacent lower panel section by means of at least a pair of rotatable hinge bodies, each of said hinge bodies being provided on their interior surfaces with a layer of hook and loop material, said layers being adapted to communicate with said strips located on said lower panel sections, and a plurality of upper panel sections adapted to be disposed above said lower panel sections at a desired angle thereto, said upper panel sections being connected to said lower panel sections by means of a plurality of padded clamps, each of said padded clamps including two interconnected rigid bodies, each of said rigid bodies being provided with padding material on their interior surfaces.

2. The acoustical shield and sound enhancing enclosure as recited in claim 1 wherein said strips of hook and loop material and said hinge bodies are disposed on the inner side edges of said lower panel sections.

3. The acoustical shield and sound enhancing enclosure as recited in claim 1 wherein said padded clamps are adapted to be disposed between adjacent upper and lower panel sections.

4. The acoustical shield and sound enhancing enclosure of claim 1 wherein said rigid bodies are angled.

5. The acoustical shield and sound enhancing enclosure of claim 1 wherein said upper and lower panel sections are of transparent material.

6. An acoustical shield and sound enhancing enclosure comprising a plurality of lower panel sections adapted to be arranged vertically at a desired angle to each other, a plurality of strips of hook and loop material being provided on the front and rear surfaces of the inner side edges of said lower panel sections, each of said lower panel sections being connected to the next adjacent lower panel section by means of at least one hinge, each of said hinges including at least one pair of rotatable hinge bodies, each of said hinge bodies including cooperating halves, each of said cooperating halves being provided with a layer of hook and loop material adapted to communicate with said strips located on said lower panel sections, and a plurality of upper panel sections adapted to be disposed above said lower panel sections at a desired angle thereto, said upper panel sections being connected to said lower panel sections by means of a plurality of padded clamps, each of said clamps including two angled interconnected rigid bodies, said rigid bodies being provided with padding material on their interior surfaces, said rigid bodies being adapted to receive the lower edge of one of said upper panel sections and the upper edge of one of said lower panel sections.

7. The acoustical shield and sound enhancing enclosure of claim 6 wherein said rigid bodies are interconnected by means of a nut and bolt.

8. The acoustical shield and sound enhancing enclosure of claim 7 wherein the portion of said rigid bodies disposed above the bolt is adapted to receive the lower edge of one of said upper panel sections and the portion of said rigid bodies disposed below the bolt is adapted to receive the upper edge of one of said lower panel sections.

9. The acoustical shield and sound enhancing enclosure of claim 6 wherein said upper and lower panel sections are of transparent material.

* * * * *